US008313157B2

(12) United States Patent
Suzuki

(10) Patent No.: US 8,313,157 B2
(45) Date of Patent: Nov. 20, 2012

(54) INKJET RECORDING APPARATUS

(75) Inventor: Michiharu Suzuki, Atsugi (JP)

(73) Assignee: Ricoh Company, Limited, Tokyo (JP)

( * ) Notice: Subject to any disclaimer, the term of this patent is extended or adjusted under 35 U.S.C. 154(b) by 286 days.

(21) Appl. No.: 12/662,105

(22) Filed: Mar. 31, 2010

(65) Prior Publication Data

US 2010/0253717 A1 Oct. 7, 2010

(30) Foreign Application Priority Data

Apr. 1, 2009 (JP) ..... 2009-088978

(51) Int. Cl.

| | |
|---|---|
| ***B41J 29/38*** | (2006.01) |
| ***B41J 2/195*** | (2006.01) |
| ***B41J 2/165*** | (2006.01) |
| ***B41J 2/17*** | (2006.01) |
| ***B41J 2/175*** | (2006.01) |

(52) U.S. Cl. ..... 347/6; 347/7; 347/30; 347/84; 347/85; 347/86

(58) Field of Classification Search ..... 347/5–7, 347/30, 84–86

See application file for complete search history.

(56) References Cited

U.S. PATENT DOCUMENTS

| | | | | |
|---|---|---|---|---|
| 6,203,295 | B1 | 3/2001 | Nishioka | |
| 2003/0107623 | A1 | 6/2003 | Sato et al. | |
| 2005/0285892 | A1 | 12/2005 | Harada et al. | |
| 2006/0164473 | A1 | 7/2006 | Davis et al. | |
| 2007/0296744 | A1 | 12/2007 | Kubota et al. | |
| 2008/0062381 | A1* | 3/2008 | Doshi et al. | 351/161 |
| 2008/0158307 | A1 | 7/2008 | Nitta et al. | |
| 2008/0218563 | A1 | 9/2008 | Okumura | |

FOREIGN PATENT DOCUMENTS

| | | |
|---|---|---|
| EP | 1 310 371 | 5/2003 |
| GB | 2 435 596 | 8/2007 |
| JP | 11-320901 | 11/1999 |
| JP | 2004-050472 | 2/2004 |
| JP | 3523511 | 4/2004 |
| JP | 2004-291385 | 10/2004 |
| JP | 3573059 | 10/2004 |
| JP | 2005-125668 | 5/2005 |
| JP | 2006-068904 | 3/2006 |
| JP | 4337500 | 9/2009 |

OTHER PUBLICATIONS

Abstract of JP 2005-125667 published on May 19, 2005.
Abstract of JP 2000-190525 published on Jul. 11, 2000.
Abstract of JP 2001-328285 published on Nov. 27, 2001.
European Search Report dated Jun. 22, 2010.

* cited by examiner

*Primary Examiner* — Jason Uhlenhake
(74) *Attorney, Agent, or Firm* — Harness, Dickey & Pierce, P.L.C.

(57) ABSTRACT

An inkjet recording device includes a liquid-droplet ejection head having nozzles for ejecting droplets of a liquid, a flexible tube member connected to the head, a tube pump disposed on the tube member to supply the liquid to the head through the tube member, a rotational press member disposed in the pump and, while rotating in a first direction, sequentially compressing the tube member to supply the liquid to the head, and a controller communicatively connected to the pump and causes the press member to rotate in the first direction and a second direction opposite to the first direction. At least one portion of the tube member is compressed with the press member while the pump is stopped. The controller, prior to rotation of the press member in the first or second direction, causes the press member to rotate in reverse with respect to the first or second direction.

5 Claims, 9 Drawing Sheets

INKJET RECORDING APPARATUS

CROSS-REFERENCE TO RELATED APPLICATIONS

The present patent application claims priority pursuant to 35 U.S.C. §119 from Japanese Patent Application No. 2009-088978, filed on Apr. 1, 2009 in the Japan Patent Office, which is incorporated herein by reference in its entirety.

BACKGROUND OF THE INVENTION

1. Field of the Invention

Illustrative embodiments of the present invention relate to an inkjet recording apparatus that ejects recording liquid onto a recording medium to form an image on the recording medium.

2. Description of the Background

Image forming apparatuses are used as printers, facsimile machines, copiers, multi-functional peripherals having two or more of the foregoing capabilities, or plotters. Such image forming apparatuses may include as an image forming section an inkjet recording device employing a liquid ejection method. The inkjet recording device ejects droplets of recording liquid, e.g., ink (hereinafter referred to as "ink droplets"), from nozzles of a recording head to form an image on a recording medium (sheet or material).

Such an inkjet recording device may include a maintenance unit that maintains good performance of the recording head. For example, a conventional type of maintenance unit includes a suction cap and a suction pump that suctions high-viscosity ink from the nozzles of the recording head covered with the suction cap. Such a conventional inkjet recording device may also include a supply pump that supplies ink from an ink cartridge to a recording head.

To perform cleaning to maintain good performance of the recording head, for example, a conventional type of inkjet recording device like that described in JP-3573059-B employs a so-called tube pump. The tube pump creates negative pressure in a capping unit that suctions ink from the recording head and supplies ink from a main tank to a sub tank through a tube. Such a tube pump has a relatively simple structure, allowing the device as a whole to be made more compact, and prevents ink contamination at a mechanical portion for suctioning and discharging ink. With such a configuration, in which ink is supplied from the main tank to the sub tank with the tube pump, while the pump is stopped, the tube is compressed in the tube pump to block a flow path and prevent ink from spontaneously flowing from the main tank to the sub tank by the negative pressure in the sub tank, thus maintaining pressure in the sub tank.

However, if the tube pump is left for a long time with the flow path of the tube blocked, compressed portions of the inner wall of the tube may stick together. Consequently, even if the pump is restarted to rotate, ink may not be supplied or suctioned. Usually, even if portions of the inner wall of the tube stick together, operating the tube pump pushes enough ink through the tube to resolve the blockage, thus allowing ink supply or suctioning to continue. However, at an approach to a compressed area of the tube, even if the pump is operated, ink may be not supplied to resolve the blockage in the tube, requiring waiting for spontaneously separation of the stuck portions of the inner wall. To prevent such a failure, it is conceivable that a sensor and a stepping motor might be used to prevent the pump from stopping at the approach to the compressed area of the tube. However, such a configuration may increase cost and size.

SUMMARY OF THE INVENTION

In an illustrative embodiment, an inkjet recording device includes a liquid-droplet ejection head, a flexible tube member, a tube pump, a rotational press member, and a controller. The liquid-droplet ejection head includes a plurality of nozzles for ejecting droplets of a recording liquid. The flexible tube member is connected to the liquid-droplet ejection head. The tube pump is disposed on the flexible tube member to supply the recording liquid to the liquid-droplet ejection head through the flexible tube member. The rotational press member is disposed in the tube pump and, while rotating in a first rotation direction, sequentially compresses the flexible tube member to supply the recording liquid to the liquid-droplet ejection head. The controller is communicatively connected to the tube pump and causes the rotational press member of the tube pump to rotate in the first rotation direction and a second rotation direction opposite to the first rotation direction. At least one portion of the flexible tube member is compressed with the rotational press member while the tube pump is stopped. The controller, prior to rotation of the rotational press member in either the first rotation direction or the second rotation direction, causes the rotational press member to rotate in reverse with respect to the first rotation direction or the second rotation direction.

BRIEF DESCRIPTION OF THE DRAWINGS

A more complete appreciation of the disclosure and many of the attendant advantages thereof will be readily acquired as the same becomes better understood by reference to the following detailed description when considered in connection with the accompanying drawings, wherein.

Figure 1:
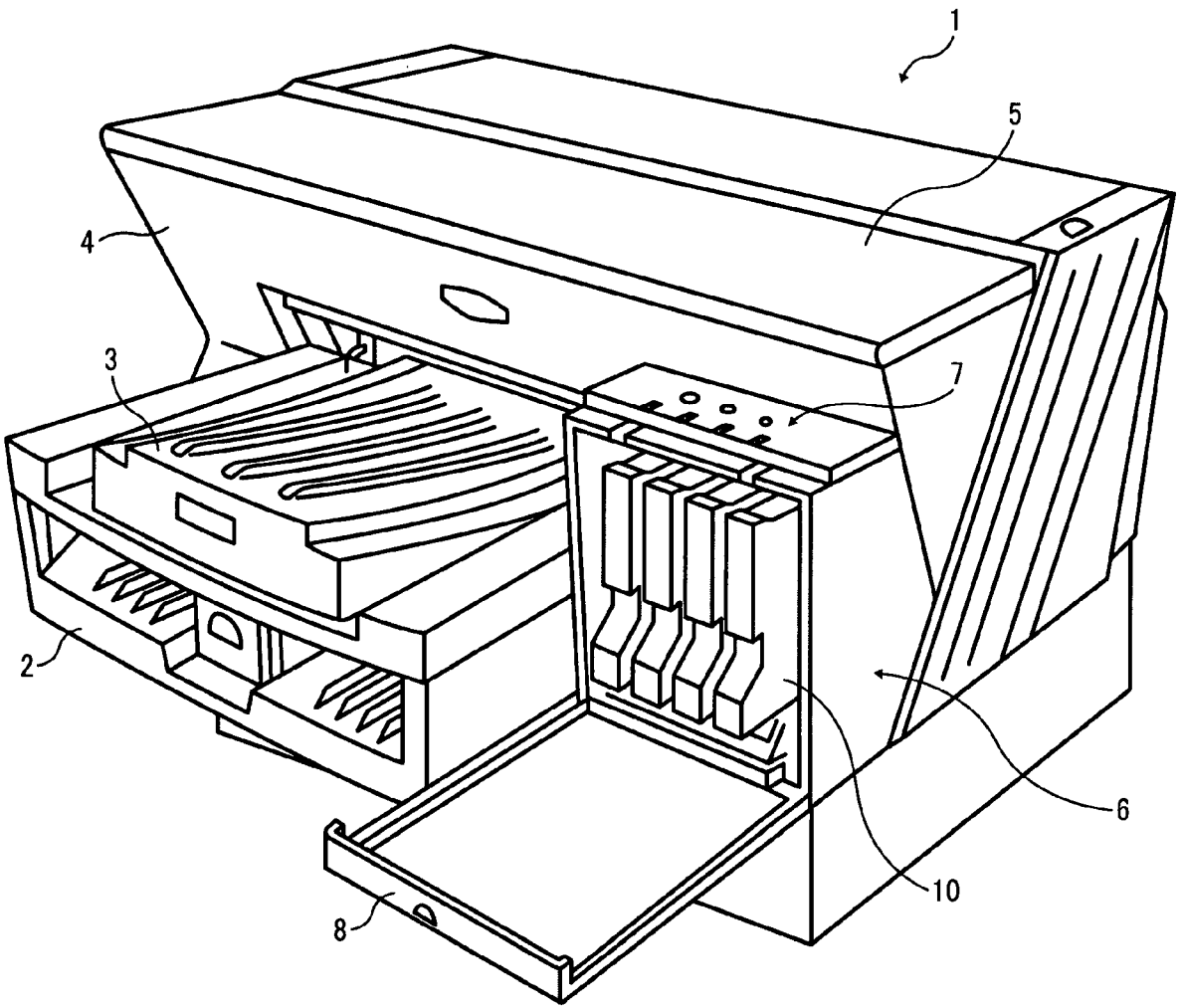
FIG. 1 is a front perspective view illustrating an image forming apparatus including an inkjet recording device according to an illustrative embodiment of the present disclosure.

The accompanying drawings are intended to depict illustrative embodiments of the present disclosure and should not be interpreted to limit the scope thereof. The accompanying drawings are not to be considered as drawn to scale unless explicitly noted.

DETAILED DESCRIPTION OF ILLUSTRATIVE EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the illustrative embodiments are described with technical limitations with reference to the attached drawings, such description is not intended to limit the scope of the present invention and all of the components or elements described in the illustrative embodiments of this disclosure are not necessarily indispensable to the present invention.

In this disclosure, the term "recording medium" may be referred to as "sheet". It is to be noted that the term "sheet" is not intended to limit the recording medium to a specific material and represents an object to which a recording liquid, e.g., ink adheres. Further, a recording sheet, a recording material, or a transfer material may be also used for a synonym of "recording medium". The term "image formation" is used herein for a synonym of "image recording" and "image printing".

Below, an example of an image forming apparatus 1 including an inkjet recording device with a maintenance unit according to an illustrative embodiment of the present disclosure is described with reference to FIG. 1.

FIG. 1 is a front perspective view illustrating the image forming apparatus 1 according to the present illustrative embodiment. The image forming apparatus 1 includes a sheet feed tray 2 that stores sheets and a sheet output tray 3 that stacks sheets on which images are recorded (formed). At one end of the front side of the image forming apparatus 1, a cartridge mount portion 6 protruding forward from a front face 4 of the image forming apparatus 1 is disposed lower than a top face 5 of the image forming apparatus 1. On a top face of the cartridge mount portion 6 is mounted an operation-and-display unit 7 including operation buttons and indicators. Ink cartridges 10 serving as main tanks that store recording liquid are removably mounted in the cartridge mount portion 6, and a front cover 8 is openably/closably provided with the cartridge mount portion 6.

Figure 2:
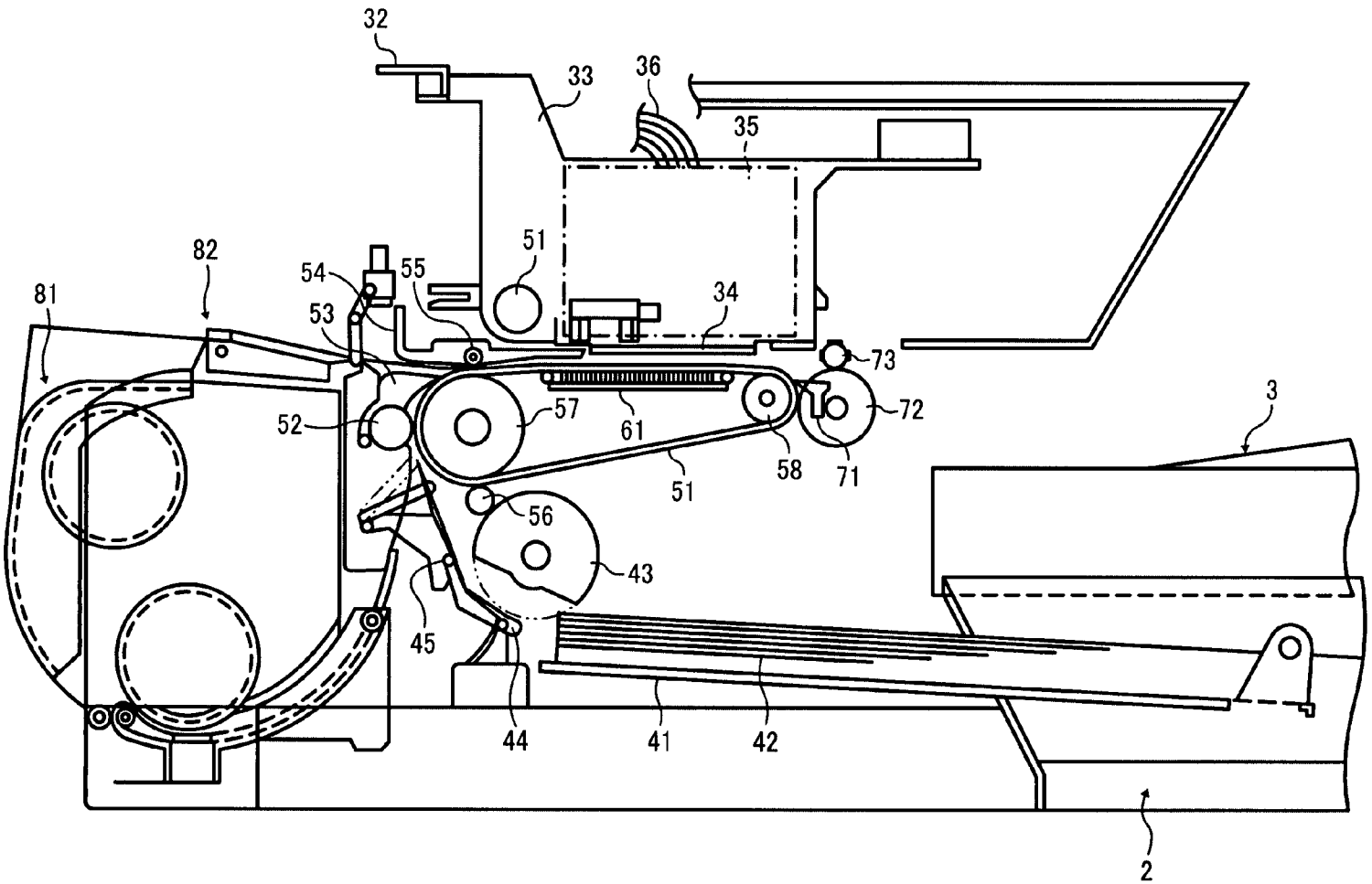
FIG. 2 is a schematic view illustrating a configuration of a mechanical section of the image forming apparatus illustrated in FIG. 1.
Figure 3:
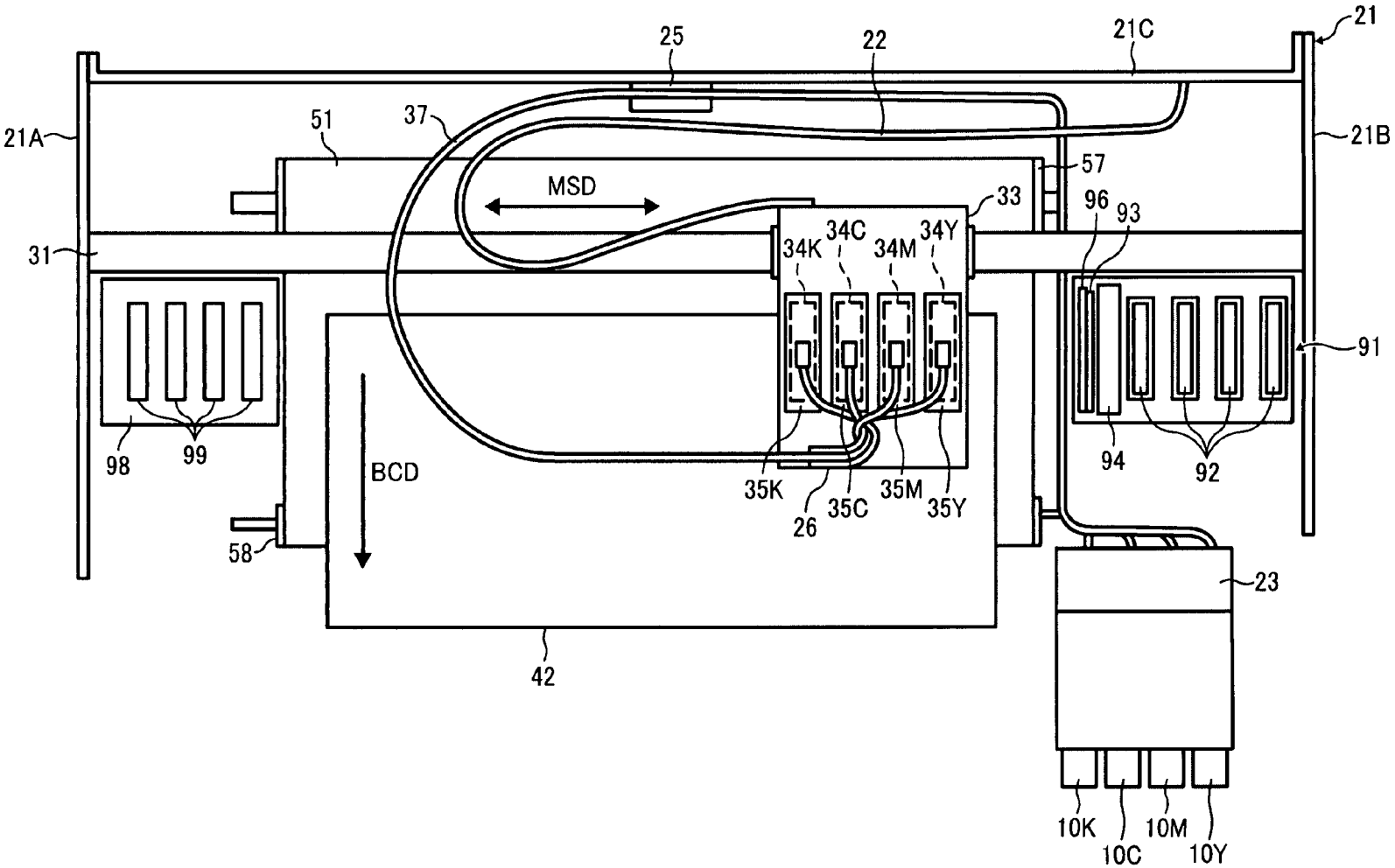
FIG. 3 is a plan view illustrating a portion of the mechanical section of the image forming apparatus illustrated in FIG. 1.

Next, a mechanical section of the image forming apparatus 1 is described with reference to FIGS. 2 and 3. FIG. 2 is a schematic view illustrating a configuration of the mechanical section of the image forming apparatus 1. FIG. 3 is a plan view illustrating a portion of the mechanical section.

In the mechanical section of the image forming apparatus 1, a carriage 33 is slidably held with a guide rod 31 and a stay 32. The guide rod 31 and the stay 32 serving as guide members extend between side plates 21A and 21B constituting a frame 21. The carriage 33 is moved by a main scan motor, not illustrated, for scanning in a main scan direction "MSD" indicated by a double arrow illustrated in FIG. 3.

On the carriage 33 are mounted recording heads 34 that are four liquid-droplet ejection heads (inkjet heads) to eject droplets of different color inks of, e.g., yellow (Y), cyan (C), magenta (M), and black (K). The recording heads 34 are mounted on the carriage 33 so that a plurality of nozzles is arranged in a direction perpendicular to the main scan direction and ink droplets are ejected downward from the nozzles. As illustrated in FIG. 3, the recording heads 34 may be formed with, for example, a recording head 34Y that ejects droplets of yellow, a recording head 34M that ejects droplets of magenta, a recording head 34C that ejects droplets of cyan, and a recording head 34K that ejects droplets of black (hereinafter collectively referred to as "recording heads 34" unless colors distinguished). It is to be noted that the configuration of the recording head(s) 34 is not limited to the above-described example and may be formed with one or more recording heads having one or more nozzle rows for ejecting liquid droplets of one or more colors.

The recording heads 34 serving as droplet ejection heads include pressure generators that generate pressure to eject liquid droplets. As such a pressure generator, the recording heads 34 may employ, for example, a piezoelectric actuator such as a piezoelectric element, a thermal actuator that uses a phase change caused by film boiling of liquid (ink) using an electro/thermal converting element such as a heat-generation resistant, a shape-memory-alloy actuator that uses a metal phase change caused by a temperature change, or an electrostatic actuator that generates pressure by electrostatic force.

On the carriage 33 is mounted a plurality of sub tanks 35Y, 35M, 35C, and 35K (hereinafter collectively referred to as "sub tanks 35") that supplies the different color inks to the recording heads 34. The different color inks are supplied (refilled) from the ink cartridges 10 (hereinafter referred to as 10K, 10C, 10M, and 10Y when colors distinguished) mounted to the sub tanks 35 via ink supply tubes 37.

The ink cartridges 10 are mounted in the cartridge mount portion 6. As illustrated in FIG. 3, the cartridge mount portion 6 is provided with a supply-pump unit 23 that supplies ink from the ink cartridges 10. The ink supply tubes 37 are held with a holder 25 on a rear plate 21C that constitutes a portion of the frame 21 and are fixed with a fixing rib 26 on the carriage 33.

As illustrated in FIG. 2, as a sheet feed section that feeds sheets 42 stacked on a bottom plate (sheet stack portion) 41 of the sheet feed tray 102, the image forming apparatus 1 includes a sheet feed roller 43 that separates the sheets 42 from the bottom plate 41 to feed the sheets 42 sheet by sheet and a separation pad 44 that is disposed opposing the sheet feed roller 43. The separation pad 44 is made of a material of a high friction coefficient and biased toward the sheet feed roller 43.

To feed the sheet 42 from the sheet feed section to a position below the recording heads 34, the image forming apparatus 1 includes a conveyance belt 51, a counter roller 52, a conveyance guide 53, a press member 54, and a front-end press roller 55. The conveyance belt 51 conveys the sheet 42 with the sheet 42 electrostatically attracted thereon. Receiving the sheet 42 from the sheet feed section via a first guide member 45, the counter roller 52 feeds the sheet 42 while sandwiching the sheet 42 between it and the conveyance belt 51. Receiving the sheet 42 sent in a substantially vertically upward direction, the conveyance guide 53 turns the sheet feed direction of the sheet 42 by substantially 90 degrees to guide the sheet 42 onto the conveyance belt 51. The front-end press roller 55 is biased toward the conveyance belt 51 with the press member 54. A charge roller 56 is provided to charge a surface of the conveyance belt 51. The conveyance belt 51 is an endless belt that is looped between a conveyance roller 57 and a tension roller 58 so as to circulate in a belt circulation direction "BCD" (sub-scanning direction) illustrated in FIG. 3 (i.e., counterclockwise in FIG. 2). The charge roller 56 is disposed so as to contact the surface of the conveyance belt 51 and rotate depending on the circulation of the conveyance belt 51. A pressing force of, e.g., 2.5N is applied to each end of a shaft of the charge roller 56.

On the inner circumferential surface of the conveyance belt 51 is disposed a second guide member 61 at a position corresponding to a print area of the recording heads 34. The upper surface of the second guide member 61 protrudes to a position closer to the recording heads 34 than a common tangent line of the conveyance roller 57 and the tension roller 58 that support the conveyance belt 51. Thus, at the print area, the conveyance belt 51 is pushed up along the upper face of the second guide member 61 while keeping a highly accurate planarity.

The image forming apparatus 1 further includes a sheet output section that outputs the sheet 42 on which an image has been formed by the recording heads 34. The sheet output section includes a separation claw 71, a first output roller 72, a second output roller 73, and the sheet output tray 3 described above. The separation claw 71 separates the sheet 42 from the conveyance belt 51. A height from a sandwich point between the first output roller 72 and the second output roller 73 to the sheet output tray 3 is set to enough height to stack a great number of sheets on the sheet output tray 3.

A duplex unit 81 is detachably mounted on a rear portion of the image forming apparatus 1. Receiving the sheet 42 returned by reverse rotation of the conveyance belt 51, the duplex unit 81 turns the sheet 42 upside down to feed the sheet 42 between the front-end press roller 55 and the conveyance belt 51. At the top face of the duplex unit 81 is formed a manual-feed tray 82.

As illustrated in FIG. 3, at a non-print area on one end in the main-scan direction of the carriage 33 is disposed a maintenance unit 91 (hereinafter also referred to as "sub-system") that maintains nozzle conditions of the recording heads 34. The maintenance unit 91 includes cap members 92*a* to 92*d* (hereinafter collectively referred to as "caps" unless distinguished) that cover the respective nozzle faces of the recording heads 34, a wiping blade 93 that is a blade member to wipe the nozzle faces of the recording heads 34, a first droplet receiver 94 that receives ink droplets discharged to remove increased-viscosity ink from nozzles for maintenance, a wiper cleaner 95 that is integrally formed with the first droplet receiver 94 and serves as a cleaning member to remove ink adhered on the wiping blade 93, and a cleaning roller 96 constituting a cleaner unit to press the wiping blade 93 against the wiper cleaner 95 in the cleaning of the wiping blade 93. Further, as illustrated in FIG. 3, a second droplet receiver 98 is disposed at a non-print area on the other end in the main-scan direction of the carriage 33. The second droplet receiver 98 receives ink droplets that are discharged to remove increased-viscosity ink during recording (image formation) and so forth for maintenance. The second droplet receiver 98 has openings 99 arranged in parallel with the nozzles rows of the recording heads 34.

In the image forming apparatus 1 having the above-described configuration, the sheet 42 is separated sheet by sheet from the sheet feed tray 102, fed in a substantially vertically upward direction, guided along the first guide member 45, and conveyed between the conveyance belt 51 and the counter roller 52. Further, the front tip of the sheet 42 is guided with the conveyance guide 53 and pressed against the conveyance belt 51 by the front-end press roller 55 to turn the conveyance direction of the sheet 42 by substantially 90°.

At this time, a control circuit causes an AC (alternating current) bias supply unit to alternately supply positive and negative voltages to the charge roller 56 so that the conveyance belt 51 is charged with an alternating voltage pattern, that is, an alternating band pattern of positively-charged areas and negatively-charged areas in the sub-scanning direction, i.e., the belt circulation direction. When the sheet 42 is fed onto the conveyance belt 51 alternately charged with positive and negative charges, the sheet 42 is electrostatically attracted on the conveyance belt 51 and conveyed in the sub-scanning direction by circulation of the conveyance belt 51.

By driving the recording heads 34 in response to image signals while moving the carriage 33 in the main scan direction, ink droplets are ejected onto the sheet 42 stopped below the recording heads 34 to form one band of a desired image. Then, the sheet 42 is fed by a certain distance and another band of the image is recorded. Receiving a recording end signal or a signal indicating that the rear end of the sheet 42 has arrived at the recording area, the recording heads 34 finish the recording operation and the sheet 42 is outputted to the sheet output tray 3.

In waiting for the next recording (print) operation, the carriage 33 moves to the maintenance unit 91 and the caps 92 cover the recording heads 34. Accordingly, the moisture of the nozzles of the recording heads 34 is kept, thus preventing an ejection failure caused by ink drying. Then, a suction pump, not illustrated, suctions ink from the nozzles with the recording heads 34 covered with the caps 92, which is called "nozzle suction" or "head suction". Thus, the recovery operation is performed to remove increased-viscosity ink (recording liquid) or air bubbles. Further, before or during a recording operation, as described above, ink droplets unrelated to a recorded image are discharged for maintenance. Such maintenance operation allows keeping a stable ejection performance of the recording heads 34.

Figure 4:
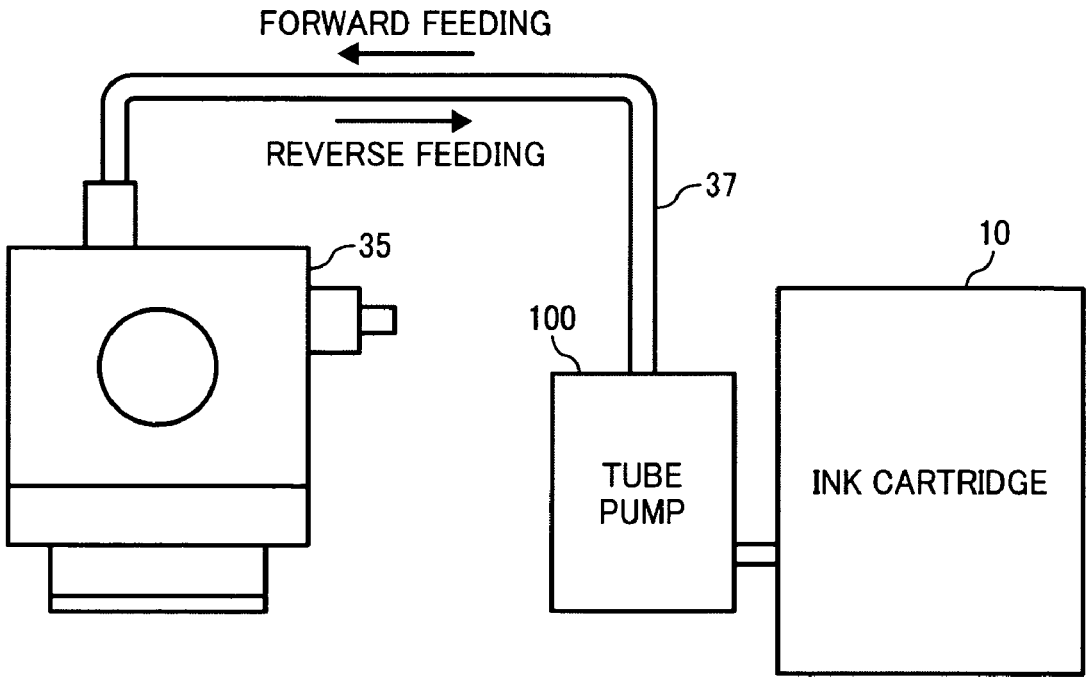
FIG. 4 is a schematic view illustrating a configuration of an ink supply tube of the inkjet recording device according to an illustrative embodiment.
Figure 5:
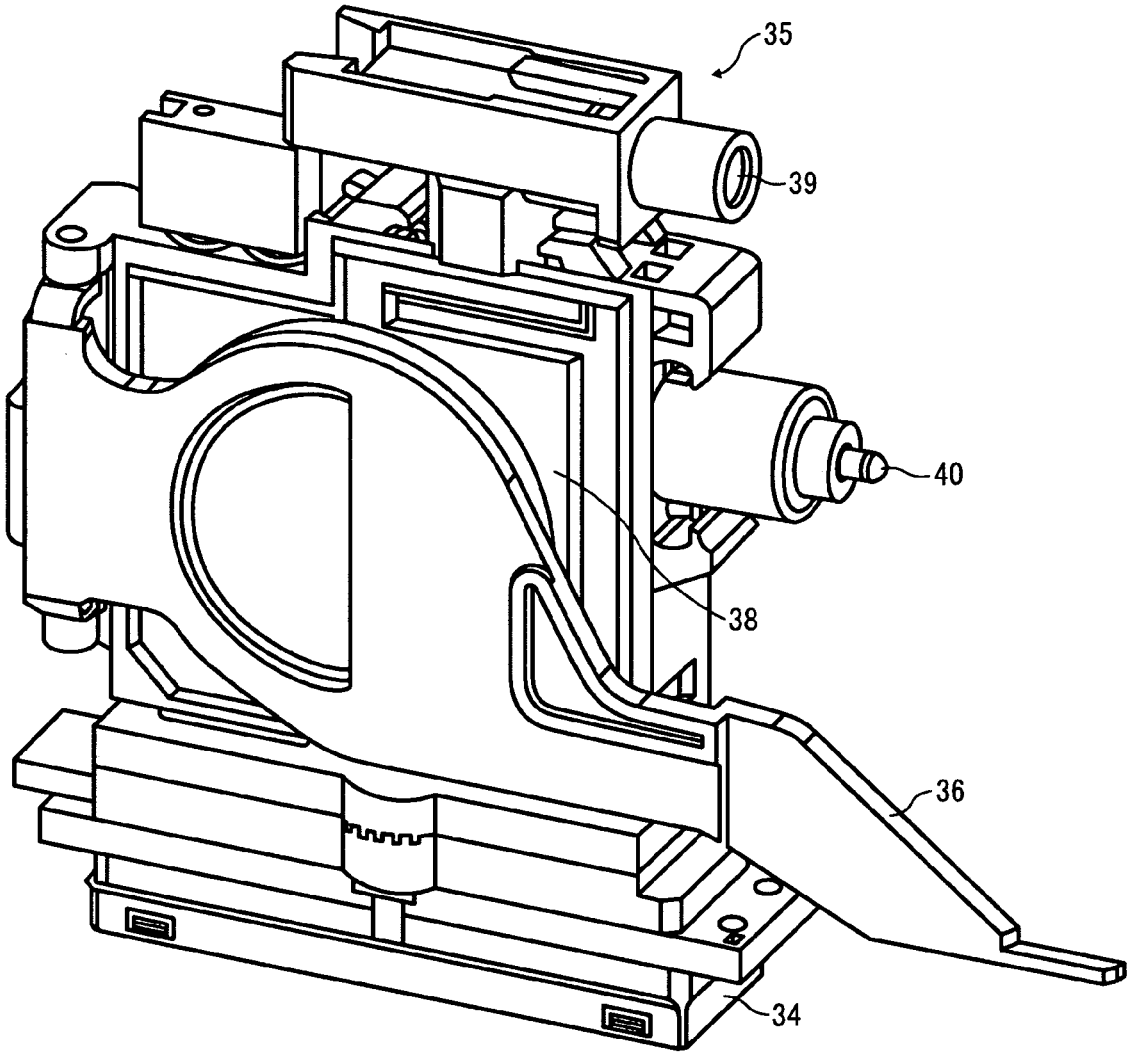
FIG. 5 is a perspective view illustrating a configuration of a sub tank usable in the inkjet recording device.

A description is given with reference to FIGS. 4 to 6 of a configuration of an ink supply system including a tube pump 100 that is disposed in the supply pump unit 23 or the maintenance unit 91 of the image forming apparatus 1 to supply and suction ink. FIG. 4 is a schematic view illustrating a configuration of an ink supply tube 37 connected between the ink cartridge 10 and the sub tank 35 via the tube pump 100. For the head configuration, different color inks are supplied to the recording heads 34 through separate tubes. As ink stored in the sub tank 35 is consumed for printing or maintenance, the tube pump 100 supplies (refills) ink from the ink cartridge 10 through the ink supply tube 37 to the sub tank 35. Further, in the present illustrative embodiment, when creating negative pressure in the sub tank 35 during maintenance, the image forming apparatus 1 returns (flows back) ink, which is stored in the sub tank 35, to the ink cartridge 10 with the tube pump 100 instead of discharging ink from the nozzles of the recording head into the droplet receiver. Such a configuration allows recycling of ink used in creating negative pressure, thus reducing waste of ink.

FIG. 5 is a perspective view illustrating a configuration of the sub tank 35. In FIG. 5, a negative-pressure lever 36 is mounted on the sub tank 35 and moved with a film 38 that deforms as ink stored in the sub tank 35 is consumed. The sub tank 35 is negatively pressurized by a spring, not illustrated, which is provided in the sub tank 35 to bias the film 38. Ink is supplied from the ink cartridge 10 via the ink supply tube 37 through a supply port 39. An air-release pin 40 is a pin with which the interior of the sub tank 35 is opened to the atmosphere when needed. At a lower portion of the sub tank 35 is mounted the recording head 34 that ejects ink droplets.

A tube pump serving as a liquid-feed pump switches forward feeding and reverse feeding (supply and suction) of ink by changing the rotation direction of a driving motor.

Figure 6A:
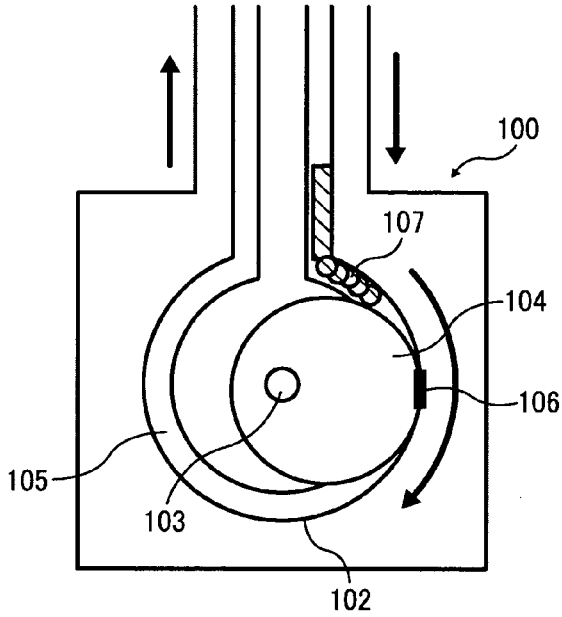
FIG. 6A is a schematic plan view illustrating a configuration of a tube pump and a state of the tube pump at which a tube is compressed with a press roller outside a portion (compression-start portion) thereof at which the press roller starts to compress the tube.
Figure 6B:
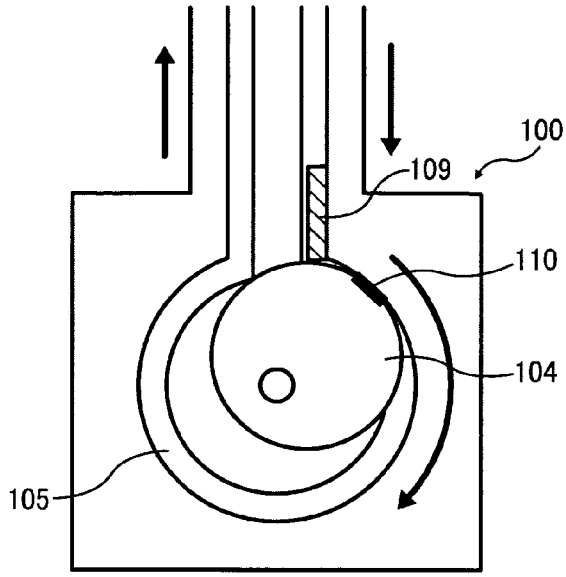
FIG. 6B is a schematic plan view also illustrating the configuration of the tube pump illustrated in FIG. 6A and a state of the tube pump at which the tube is compressed with the press roller at the portion (compression-start portion) at which the press roller starts to compress the tube.

As illustrated in FIGS. 6A and 6B, a flexible tube 105 is wound in the tube pump 100 so as to be supported with a tube support face 102. By rotating a press roller 104 of an eccentric cam type around a center of axis 103, the tube 105 is pressed against the tube support face 102 and partially compressed. When the press roller 104 is further rotated, the compressed point of the tube 105 moves in a predetermined rotation direction, thereby feeding ink in the rotation direction of the press roller 104. The driving motor for rotating the press roller 104 may be, e.g., a DC (direct current) motor in view of cost reduction.

The tube pump 100 supplies and suctions ink by a restoration force generated when the compressed portion of the tube 105 restores the original state, and has enough flexibility to prevent an excessive increase in the rotation torque of the driving force of the tube pump 100. The tube 105 may be, e.g., a rubber tube of a hardness of approximately 50 to 65. With such a configuration, when the tube pump 100 is stopped, at least one portion of the tube 105 is compressed to block the flow path of the tube 105, thus preventing ink from spontaneously flowing through the tube 105 by a difference in pressure between portions upstream and downstream from the compressed portion. However, with such a configuration, since the tube 105 remains compressed while the tube pump 100 is stopped, portions of the inner wall of the tube 105 might stick together after a long unused time and keeps blocking the flow path even when the tube pump 100 is restarted to rotate the press roller 104. For example, as illustrated in FIG. 6A, when in the rotation direction of the press roller 104 a stop position 106 of the press roller 104 is outside an end portion (compression-start portion) 110 of the tube support face 102 at which the press roller 104 starts to compress the tube 105, rotating the press roller 104 in a direction indicated by an arrow in FIG. 6A delivers ink 107 to the stop position 106. Accordingly, even if portions of the inner wall of the tube 105 might stick together, the ink 107 resolves the sticking, thus allowing ink to be properly supplied. However, as illustrated in FIG. 6B, in a case where the tube 105 is compressed with the press roller 104 at the compression-start portion 110 of the tube support face 102 at which the press roller 104 starts to compress the tube 105, even if the press roller 104 rotates in the direction indicated by an arrow in FIG. 6B, ink 107 may not be pushed or drawn by the restoration force of the tube 105. Consequently, the pump may not deliver ink until the sticking of the tube 105 resolves by itself.

The present illustrative embodiment prevents such a failure without adding to the tube pump a complex configuration or an expensive component. One example is described with reference to FIGS. 7A and 7B.

Figure 7A:
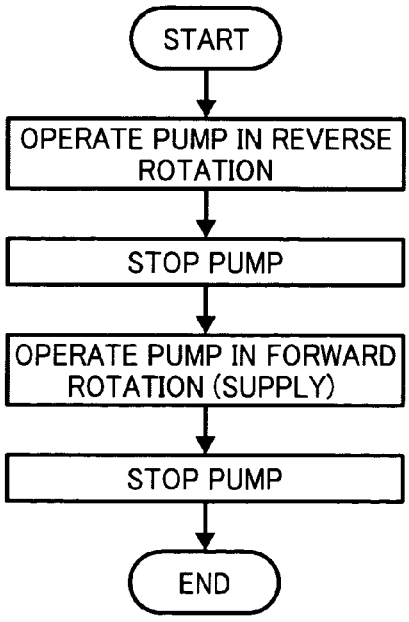
FIGS. 7A and 7B are flowcharts illustrating control processes performed when the pump is driven to supply (FIG. 7A) and suction (FIG. 7B) ink.
Figure 7B:
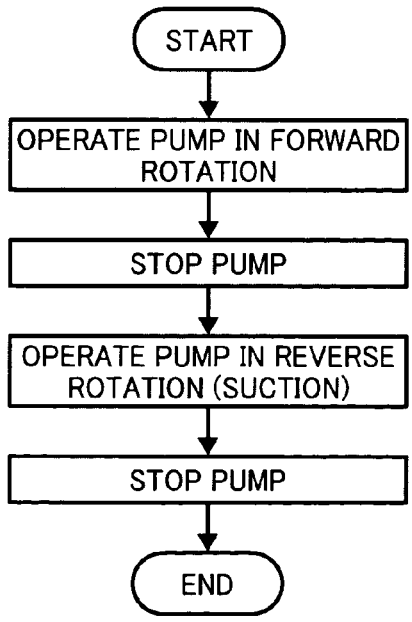
Figure 8:
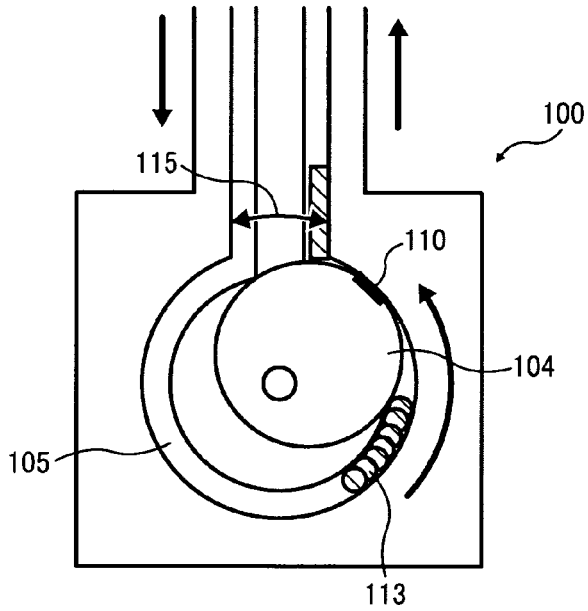
FIG. 8 is a schematic view illustrating a reverse operation of the tube pump.

FIGS. 7A and 7B are flowcharts illustrating control processes performed when the pump is driven to supply (FIG. 7A) and suction (FIG. 7B) ink. In the control processes illustrated in FIGS. 7A and 7B, before the press roller of the tube pump is rotated in an intended direction, the press roller is rotated in reverse. To prevent the above-described failure without changing the structure, as illustrated in FIG. 8, the press roller 104 is controlled to rotate in reverse before rotating in the direction indicated by the arrow in FIG. 6A or 6B. Accordingly, since ink 113 is pushed out from a tube winding portion of the tube pump 100, the sticking of the inner wall of the tube 105 at the compression-start portion 110 is resolved. At this time, the press roller 104 is rotated by an angle greater than an angle of an area in which ink is not delivered by compressing of the tube 105 with the press roller 104.

Figure 9:
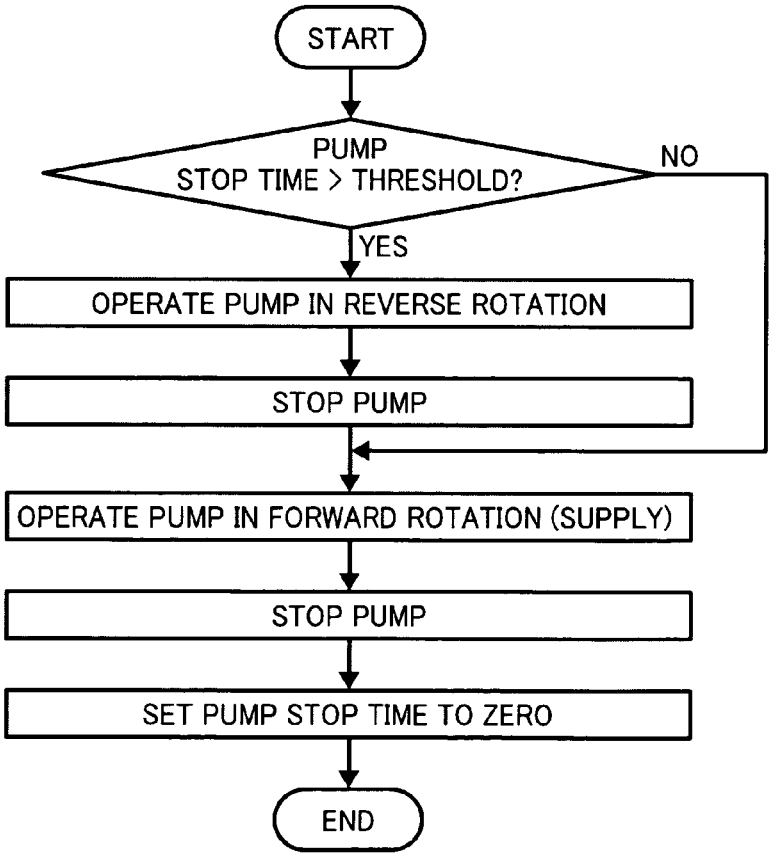
FIG. 9 is a flowchart illustrating a control process of determining whether the reverse operation of the tube pump is to be executed according to the length of the stop time of the pump.

The above-described failure does not occur unless the pump is stopped for such a long time that portions of the inner wall of the tube remain sticking together so as not to restore the original shape. Hence, in consideration of the product life, a threshold time (Trevreq: time of reverse-rotation request) may be set for a stop time for which the tube pump is stopped until the reverse rotation of the press roller is needed, and the stop time of the tube pump may be monitored. Then, as illustrated in FIG. 9, if the stop time of the tube pump exceeds the threshold time, the press roller is controlled to rotate in reverse. By contrast, if the stop time of the tube pump does not exceed the threshold time, the press roller is controlled so as not to rotate in reverse. With this configuration, after the pump is operated, the stop time is reset to monitor another stop time.

Figure 10:
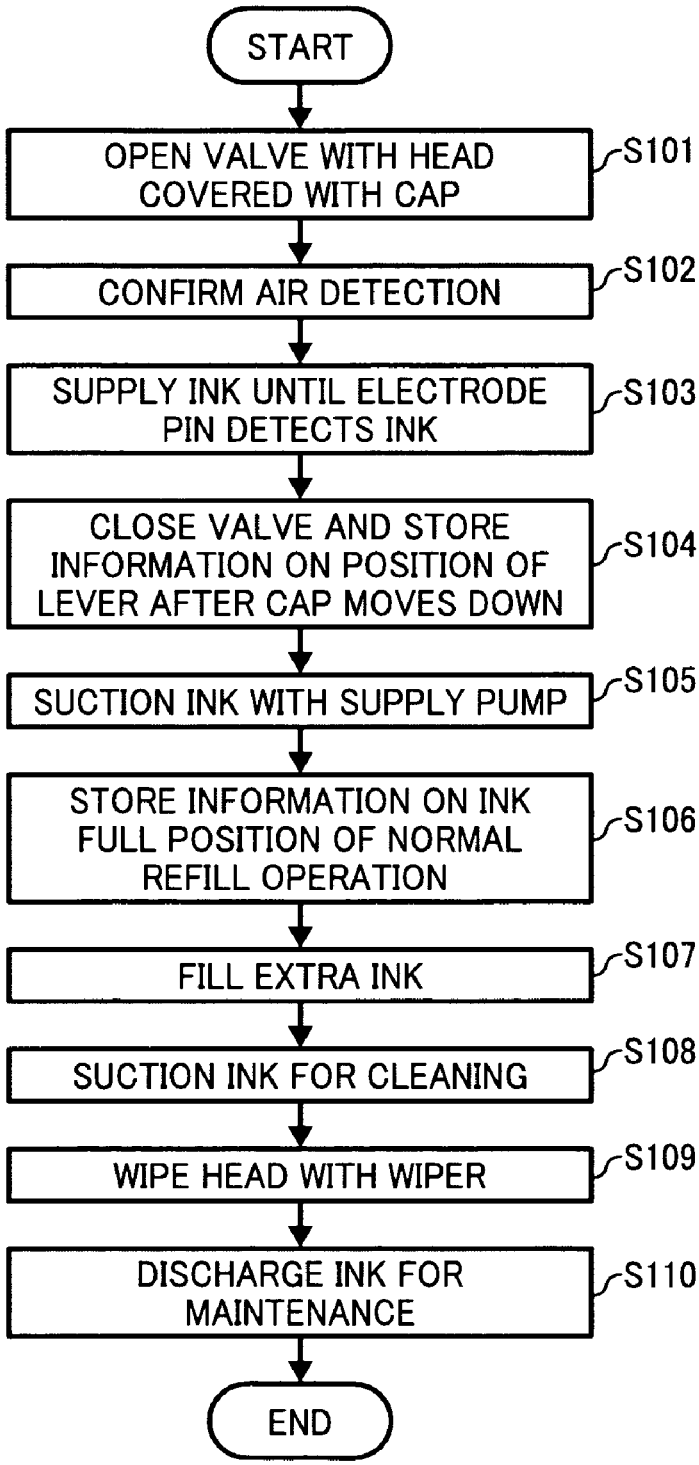
FIG. 10 is a flowchart illustrating a control process executed when the tube pump does not suction ink except during execution of an air-release refill sequence.

Further, the tube pump may perform only supply operation without performing suctioning operation except during an air-release refill sequence illustrated in FIG. 10. In such a case, the above-described reverse rotation is executed only when supply operation is performed. In the air-release refill sequence illustrated in FIG. 10, before ink is suctioned with the tube pump (suctioning operation), ink supply (supply operation) is performed until an electrode pin (supply operation) is detected. Accordingly, the reverse rotation of the press roller is already performed.

The air-release refill is a method of filling ink to the sub tank while releasing air from the sub tank and the supply route. As illustrated in FIG. 10, at S101 an air release valve is opened with the head nozzles with the suction cap. At S102, by detecting that the electrode pin is not in contact with ink in the sub tank, it is confirmed that the air release has been successfully performed. At S103, the tube pump supplies ink to the sub tank until ink is detected with the electrode pin. At S104, the air-release valve is closed, the suction cap moves down, and information on a position of the negative-pressure lever before creation of negative pressure is stored on a storage unit such as a memory. At S105, the tube pump suctions ink. At S106, information on the negative pressure created by suctioning of the tube pump is stored in association with a position of the negative-pressure lever. At S107, the suction pump supplies an enough amount of ink to perform subsequent cleaning and maintenance discharge. At S108, the suction pump connected to the caps suctions ink from the recording heads for cleaning. At S109, the recording heads are wiped with the wiping blade. At S110, maintenance discharge is performed, and the process ends.

Figure 11:
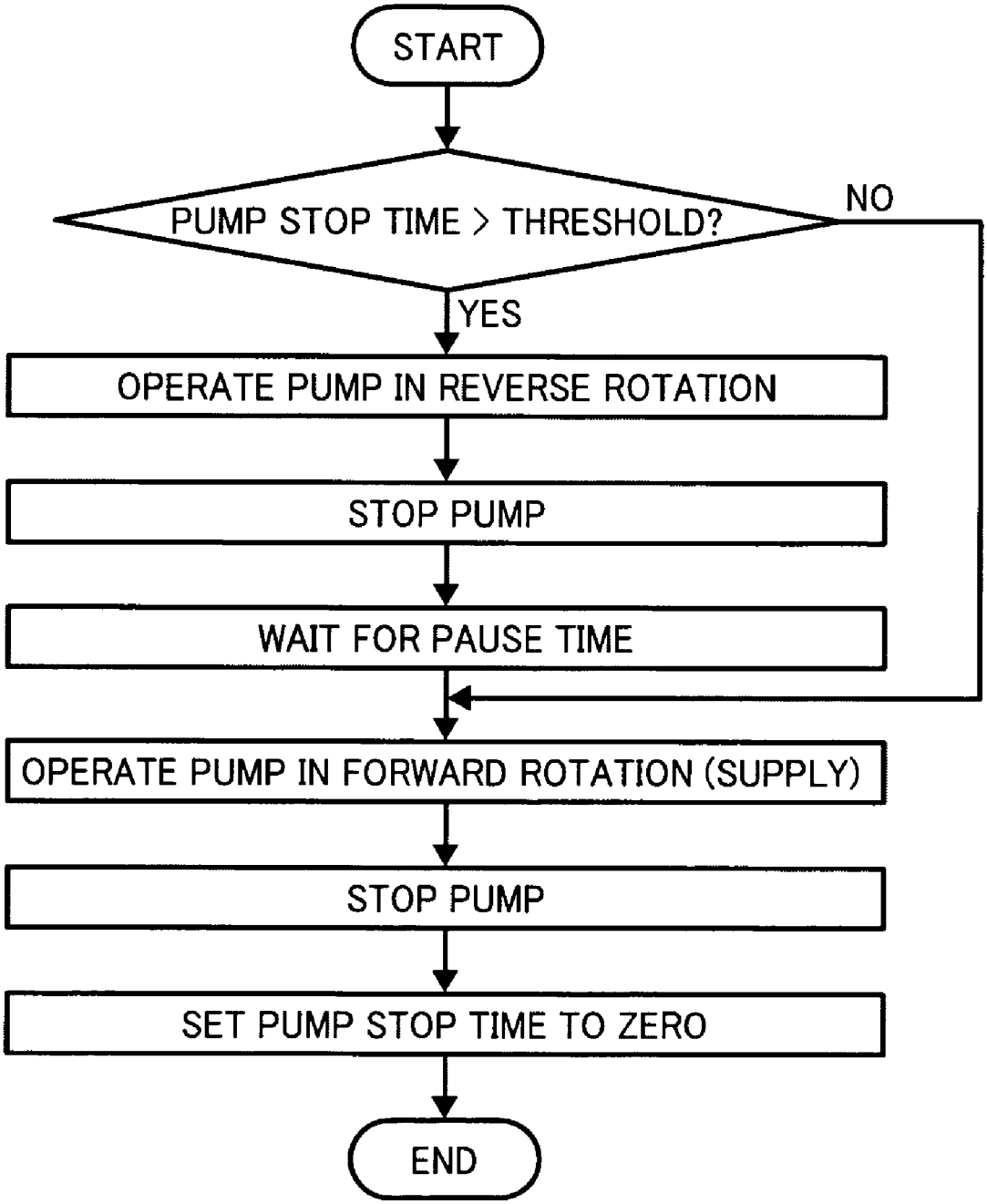
FIG. 11 is a flowchart illustrating a control process usable to enhance the product life of the tube pump by reducing the load of the pump caused by inertial force.

Further, in view of the product life of the tube pump, as illustrated in FIG. 11, a pause time during which no signal is transmitted to the tube pump may be set to temporarily stop the press roller of the tube pump when the press roller is rotated. For example, the pause time may be set to a time period longer than a time period from when the driving motor receives a stop signal to when the driving motor actually stops. Such a configuration prevents teeth of gears of the driving motor from being damaged by starting reverse rotation of the driving motor with the driving motor still operating by inertial force.

The above-described control method is applicable to inkjet recording employing, for example, an ink that contains water, pigment, polymer, and water-soluble organic solvent. The proportion of pigment in the ink may be, e.g., 6 weight percent or greater, and the viscosity of the ink at 25° C. may be, e.g., in a range of 5 mPa·sec or greater and 20 mPa·sec or less. The surface tension of the ink may be, e.g., 40 dyne/cm or less.

Numerous additional modifications and variations are possible in light of the above teachings. It is therefore to be understood that within the scope of the appended claims, the disclosure of the present invention may be practiced otherwise than as specifically described herein.

With some embodiments of the present invention having thus been described, it will be obvious that the same may be varied in many ways. Such variations are not to be regarded as a departure from the scope of the present invention, and all such modifications are intended to be included within the scope of the present invention.

For example, elements and/or features of different illustrative embodiments may be combined with each other and/or substituted for each other within the scope of this disclosure and appended claims.

What is claimed is:

1. An inkjet recording device comprising:

a liquid-droplet ejection head comprising a plurality of nozzles for ejecting droplets of a recording liquid;

a flexible tube member connected to the liquid-droplet ejection head;

a tube pump disposed on the flexible tube member to supply the recording liquid to and suction the recording liquid from the liquid-droplet ejection head through the flexible tube member;

a rotational press member disposed in the tube pump, the rotational press member, while rotating in a first rotation direction, sequentially compressing the flexible tube member to supply the recording liquid to the liquid-droplet ejection head and, while rotating in a second rotation direction opposite to the first rotation direction, sequentially compresses the flexible tube to suction the recording liquid from the liquid-droplet ejection head; and a controller communicatively connected to the tube pump, the controller causing the rotational press member of the tube pump to rotate in the first rotation direction and the second rotation direction opposite to the first rotation direction, wherein at least one portion of the flexible tube member is compressed by the rotational press member while the tube pump is stopped, and the controller, in response to an instruction to rotate the rotational press member in one of the first rotation direction or the second rotation direction, first causes the rotational press member to rotate in reverse with respect to the instructed first rotation direction or the second rotation direction and then rotate in the instructed first rotation direction or the second rotation direction.

2. The inkjet recording device according to claim 1, wherein the tube member is wound so as not to be compressed with the rotational pressing member through a first angular range thereof and the controller causes the rotational press member to rotate through a second angular range greater than the first angular range when causing the rotational press member to rotate in reverse.

3. The inkjet recording device according to claim 1, wherein, when the tube pump is stopped for a threshold time period, the controller causes the rotational press member to rotate in reverse.

4. The inkjet recording device according to claim 1, wherein, prior to rotation of the rotational press member in the first rotation direction or the second rotation direction, the controller causes the rotational press member to rotate in reverse with respect to the first rotation direction or the second rotation direction and pause the tube pump.

5. The inkjet recording device according to claim 1, wherein the recording liquid is an ink comprising water, a pigment, a polymer, and a water-soluble organic solvent, a proportion of the pigment in the ink is 6 weight percent or greater, a viscosity of the ink at 25° C. is in a range of 5 mPa·sec or greater and 20 mPa·sec or less, and a surface tension of the ink is 40 dyne/cm or less.

* * * * *